US006688395B2

(12) United States Patent
Maguire et al.

(10) Patent No.: US 6,688,395 B2
(45) Date of Patent: Feb. 10, 2004

(54) EXPANDABLE TUBULAR HAVING IMPROVED POLISHED BORE RECEPTACLE PROTECTION

(75) Inventors: Patrick G. Maguire, Cypress, TX (US); Robert J. Coon, Missouri City, TX (US); J. Eric Lauritzen, Kingwood, TX (US); Khai Tran, Pearland, TX (US); Neil A. A. Simpson, Aberdeen (GB); A. Craig Mackay, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 83 days.

(21) Appl. No.: 10/003,578

(22) Filed: Nov. 2, 2001

(65) Prior Publication Data

US 2003/0085041 A1 May 8, 2003

(51) Int. Cl.[7] ..... E21B 43/10
(52) U.S. Cl. ..... 166/380; 166/207
(58) Field of Search ..... 166/50, 313, 117.6, 166/242.6, 242.7, 380, 206, 207, 208

(56) References Cited

U.S. PATENT DOCUMENTS

| | | | | |
|---|---|---|---|---|
| 761,518 | A | 5/1904 | Lykken | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | |
| 1,930,825 | A | 10/1933 | Raymond | |
| 1,981,525 | A | 11/1934 | Price | 166/4 |
| 2,214,226 | A | 9/1940 | English | 166/1 |
| 2,383,214 | A | 8/1945 | Prout | 153/82 |
| 2,499,630 | A | 3/1950 | Clark | 153/81 |
| 2,627,891 | A | 2/1953 | Clark | 153/82 |

(List continued on next page.)

FOREIGN PATENT DOCUMENTS

| | | | |
|---|---|---|---|
| EP | 0 961 007 A2 | 12/1999 | E21B/33/10 |
| GB | 2 216 926 | 10/1989 | E21B/7/20 |
| GB | 2 320 734 A | 7/1998 | E21B/33/127 |
| GB | 2 329 918 | 4/1999 | E21B/43/10 |
| GB | 2 347 950 A | 9/2000 | E21B/33/047 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37773 | 6/2000 | E21B/43/10 |

OTHER PUBLICATIONS

PCT International Search Report, International Application No. PCT/GB 02/04898, dated Feb. 17, 2003.

(List continued on next page.)

*Primary Examiner*—Frank Tsay
(74) *Attorney, Agent, or Firm*—Moser, Patterson & Sheridan, L.L.P.

(57) ABSTRACT

The present invention provides an expandable tubular having improved polished bore receptacle protection. The present invention further provides methods for completing a wellbore through the use of an expandable string of casing having improved polished bore receptacle protection. In one aspect, the invention includes a liner member having an expandable section, and a polished bore receptacle positioned below the expandable section. The expandable section is run into a wellbore, and is positioned to overlap with the bottom portion of a string of casing already set within the wellbore. The expandable section is then expanded into frictional engagement with the surrounding casing. The expandable section optionally includes at least one sealing member and at least one slip member on the outer surface. In one aspect, a transition section is provided between the expandable section and the polished bore receptacle. The transition section defines a sloped inner diameter which provides further protection for the sealing surfaces of the polished bore receptacle as tools, fluid, and tubulars are transited downhole through the polished bore receptacle.

18 Claims, 3 Drawing Sheets

U.S. PATENT DOCUMENTS

| | | | | |
|---|---|---|---|---|
| 2,663,073 | A | 12/1953 | Bieber et al. | 29/148 |
| 2,898,971 | A | 8/1959 | Hampel | 153/82 |
| 3,087,546 | A | 4/1963 | Wooley | 166/46 |
| 3,191,677 | A | 6/1965 | Kinley | 166/14 |
| 3,195,646 | A | 7/1965 | Brown | 166/208 |
| 3,467,180 | A | 9/1969 | Pensotti | 165/180 |
| 3,712,376 | A | 1/1973 | Owen et al. | 166/277 |
| 3,776,307 | A | 12/1973 | Young | 166/125 |
| 3,818,734 | A | 6/1974 | Bateman | 72/75 |
| 3,911,707 | A | 10/1975 | Minakov et al. | 72/76 |
| 3,948,321 | A | 4/1976 | Owen et al. | 166/277 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,052,483 | A | 10/1991 | Hudson | 166/55 |
| 5,271,472 | A | 12/1993 | Leturno | 175/107 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,743,335 | A | 4/1998 | Bussear | 166/285 |
| 5,901,787 | A | 5/1999 | Boyle | 166/135 |
| 6,021,850 | A | 2/2000 | Wood et al. | 166/380 |
| 6,029,748 | A | 2/2000 | Forsyth et al. | 166/380 |
| 6,098,717 | A | 8/2000 | Bailey et al. | 166/382 |
| 6,135,208 | A | * 10/2000 | Gano et al. | 166/313 |
| 6,138,761 | A | * 10/2000 | Freeman et al. | 166/313 |

OTHER PUBLICATIONS

U.S. patent application Ser. No. 10/003,968, Maguire, filed Oct. 24, 2001.

U.S. patent application Ser. No. 09/969,089, Maguire et al., filed Oct. 2, 2001.

U.S. patent application Ser. No. 09/964,160, Cameron, filed Sep. 26, 2001.

U.S. patent application Ser. No. 09/964,034, Cameron, filed Sep. 26, 2001.

U.S. patent application Ser. No. 09/949,986, Maguire et al., filed Sep. 10, 2001.

U.S. patent application Ser. No. 09/949,057, Coon, filed Sep. 7, 2001.

U.S. patent application Ser. No. 09/946,196, Lauritzen et al., filed Sep. 5, 2001.

U.S. patent application Ser. No. 09/938,176, Coon, filed Aug. 23, 2001.

U.S. patent application Ser. No. 09/938,168, Coon, filed Aug. 23, 2001.

U.S. patent application Ser. No. 09/885,500, Maguire et al., filed Jun. 20, 2001.

U.S. patent application Ser. No. 09/848,900, Haugen et al., filed May 4, 2001.

U.S. patent application Ser. No. 09/828,508, Simpson et al., Apr. 6, 2001.

U.S. patent application Ser. No. 09/470,176, Metcalfe et al., filed Dec. 22, 1999.

U.S. patent application Ser. No. 09/470,154, Metcalfe et al., filed Dec. 22, 1999.

U.S. patent application Ser. No. 09/469,692, Trahan, filed Dec. 22, 1999.

U.S. patent application Ser. No. 09/469,690, Simpson, filed Dec. 22, 1999.

U.S. patent application Ser. No. 09/469,681, Metcalfe et al., filed Dec. 22, 1999.

U.S. patent application Ser. No. 09/469,643, Metcalfe et al., filed Dec. 22, 1999.

U.S. patent application Ser. No. 09/469,526, Metcalfe et al., filed Dec. 22, 1999.

* cited by examiner

EXPANDABLE TUBULAR HAVING IMPROVED POLISHED BORE RECEPTACLE PROTECTION

BACKGROUND OF THE INVENTION

1. Field of the Invention

The present invention relates to wellbore completion. More particularly, the invention relates to a system of completing a wellbore through the expansion of tubulars. More particularly still, the invention relates to a tubular that can be expanded into another tubular to provide both sealing and mechanical slip means while protecting a polished bore receptacle sealing surface.

2. Description of the Related Art

Hydrocarbon and other wells are completed by forming a borehole in the earth and then lining the borehole with steel pipe or casing to form a wellbore. After a section of wellbore is formed by drilling, a section of casing is lowered into the wellbore and temporarily hung therein from the surface of the well. Using apparatus known in the art, the casing is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. In this manner, wells are typically formed with two or more strings of casing of an ever-decreasing diameter.

In one well completion scheme, a well is completed by cementing and then perforating the casing to provide a fluid path for hydrocarbons to enter the wellbore. Hydrocarbons flow from the formation and are urged into a screened portion of production tubing within the casing. Because the annulus between the liner and the production tubing is sealed with packers, the hydrocarbons flow into the production tubing and then to the surface.

In another well completion scheme, the bottom portion of the last string of casing, or liner, is pre-slotted or perforated. In this arrangement, the liner is not cemented into the well, but instead serves as a primary conduit for hydrocarbons to flow back to the surface for collection. In these wells, the upper end of the perforated liner is hung off of an upper string of casing within the wellbore. A string of production tubing is then "stung" into the top of the liner to receive and carry hydrocarbons upwards in the wellbore. In this manner, the liner is sealingly "tied back" to the surface.

Known methods for tying a string of production tubing into a downhole liner typically involve the use of a tool known as a polished bore receptacle. The polished bore receptacle, or PBR, is a separate tool which is typically connected to the top of the liner by a threaded connection. The PBR has a smoothed cylindrical inner bore designed to receive the lower end of the production string. The production tubing is landed in the PBR in order to form a sealed connection between the production tubing and the liner.

Methods are emerging which involve the expansion of tubulars in situ. In addition to simply enlarging a tubular, the technology permits the physical attachment of a smaller tubular to a larger tubular by increasing the outer diameter of the smaller tubular with radial force from within. The expansion can be effected by a shaped member urged through the tubular to be expanded. More commonly, expansion methods employ rotary expander tools which are run into a wellbore on a working string. Such expander tools include radially expandable members which, through fluid pressure, are urged outward radially from the body of the expander tool and into contact with a tubular therearound. As sufficient pressure is generated on a piston surface behind these expansion members, the tubular being acted upon by the expansion tool is expanded into plastic deformation. The expander tool is then rotated within the expandable tubular. In this manner, the inner and outer diameters of the tubular are increased in the wellbore. By rotating the expander tool in the wellbore and translating the expander tool axially in the wellbore, a tubular can be expanded along a predetermined length.

It is desirable to employ expansion technology in connection with wellbore completions which utilize polished bore receptacles. A known arrangement for a PBR would place the PBR above a section of casing to be expanded. The upper section of the lower string of casing would be expanded into frictional engagement with an upper string of casing. Such an arrangement is shown in FIG. 1.

FIG. 1 illustrates a wellbore 5 completed with casing 15, and also having a lower string of casing, or liner 10, therein. In this Figure, an upper portion of the liner 10 has been expanded in situ into contact with the surrounding casing 15. In this manner, the liner 10 has been frictionally hung in the wellbore 5. The liner 10 includes a polished bore receptacle (PBR) 25 disposed above the expanded section of tubular. The PBR 25 is later used as a sealed coupling to a string of production tubing (not shown).

There are disadvantages to the use of the PBR arrangement shown in FIG. 1. First, it is noted that the PBR is exposed at the uppermost portion of the liner 10. In this position, the polished bore receptacle 25 is susceptible to damage as other downhole tools are run into the wellbore 5. In this respect, downhole tools being run through the PBR 25 most likely would impact the upper surface of the polish bore receptacle 35 on their way downhole, causing burrs or nicks that would hinder the sealing ability of the PBR 25. In much the same way, a slightly misaligned run in string may pass the polish bore receptacle upper surface 35 and damage the interior sealing surface 30. Nicks or burrs on the polish bore receptacle interior sealing surface 30 reduce the effectiveness of later sealing operations.

Downhole tools and run in strings are not the only sources of potential PBR sealing surface 30 damage. Drilling debris, such as residues from cementing the liner 10 into the borehole 5, also have the potential to degrade PBR sealing surfaces 30. Moreover, the position of the PBR 25 in the upper portion 20 of the liner 10 increases the likelihood that the removal of drilling debris and residues will have a deleterious impact on polished bore receptacle seal reliability.

There is a need, therefore, for a method of expanding a tubular such as a string of casing into contact with another string of casing therearound, and which employs a polished bore receptacle without harming the integrity of the PBR. There is a further need for a method and apparatus for providing a polished bore receptacle into a wellbore liner that protects the PBR sealing surfaces, thereby improving seal reliability.

SUMMARY OF THE INVENTION

The present invention provides apparatus and methods for providing a polished bore receptacle within an expandable liner for wellbore completion. The invention includes a liner member having an upper expandable section, and then a lower portion which defines a polished bore receptacle. In one aspect, the expandable section includes a sealing member and a slip member around its outer surface. In another aspect, the inner diameter of the liner above the PBR is configured to protect the sealing surfaces of the polished bore receptacle during wellbore completion.

BRIEF DESCRIPTION OF THE DRAWINGS

So that the manner in which the features of the present invention are attained and can be understood in detail, a more particular description of the invention, briefly summarized above, may be had by reference to certain embodiments thereof which are illustrated in the appended drawings. It is to be noted, however, that the appended drawings (FIGS. 2–7) illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
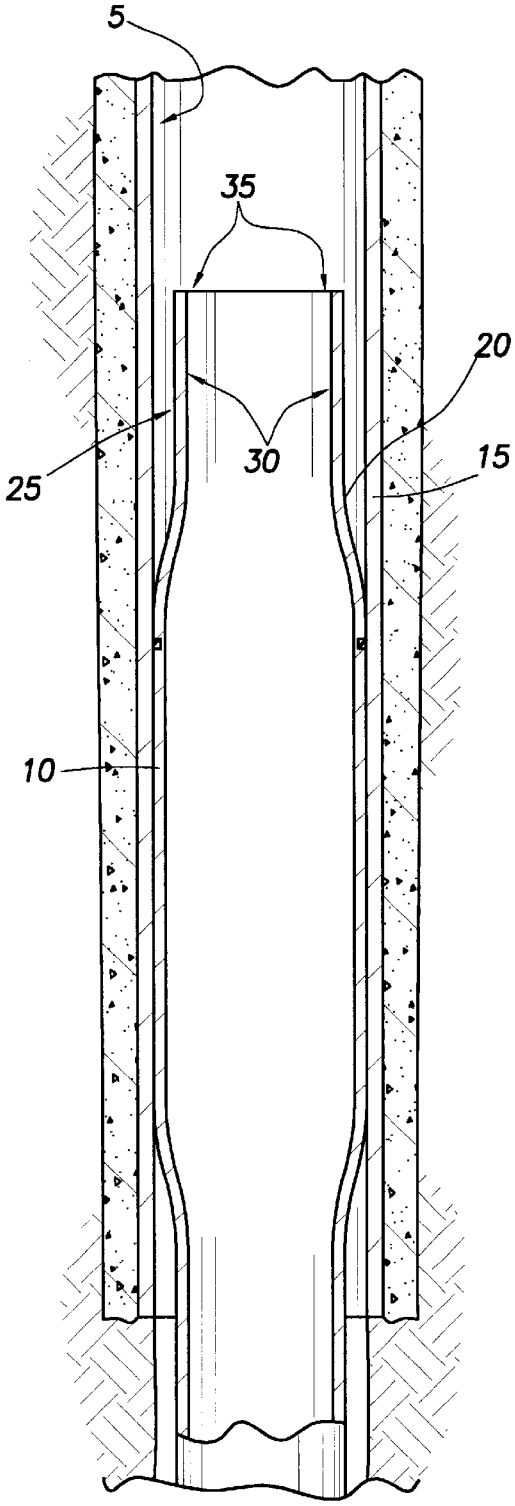
FIG. 1 is a sectional view of a novel wellbore having an upper string of casing, and having an expandable liner disposed at a lower end thereof. A polished bore receptacle is positioned at the uppermost end of the expandable liner.
Figure 2:
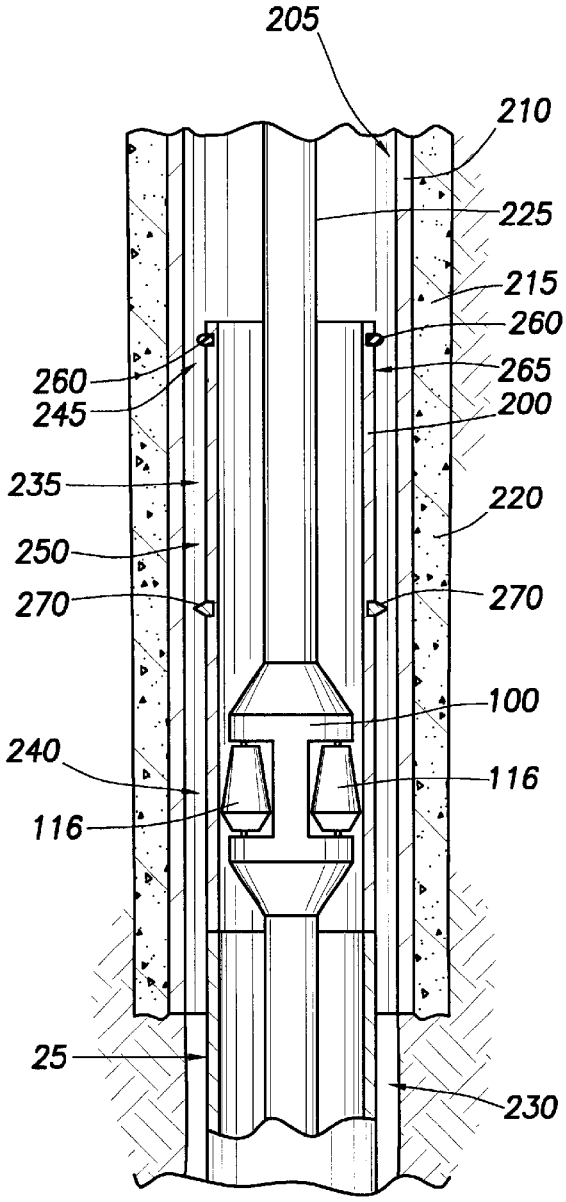
FIG. 2 is a sectional view of a wellbore having an upper string of casing, and having an expandable liner positioned at a lower end thereof. The wellbore also includes an exemplary expander tool having been run into the wellbore on a working string.

FIG. 2 is a cross-sectional view of a wellbore 205 having an upper string of casing 210 disposed therein. The annulus 215 between the upper string of casing 210 and the formation 220 has been filled with cement so as to set the upper string of casing 210. In the view of FIG. 2, only the lower section of casing 210 is visible in the wellbore 205; however, it is understood that the casing string 210 extends upward in the wellbore 205. The casing string 210 shown in FIG. 2 is an intermediate casing string. However, the scope of the methods and apparatus of the present invention have application when the casing string 210 is a string of surface casing.

FIG. 2 also presents a lower string of casing 200 within the wellbore 205. The lower string of casing 200 is sometimes referred to as a "liner." The liner 200 has an upper end 245 which, as shown in FIG. 2, is disposed in the wellbore 205 so as to overlap with the lower end of the upper casing string 210. It is understood that the liner 200 also has a lower end (not shown).

The liner 200 is typically run into the wellbore 205 on a working string 225. FIG. 2 illustrates placement of the liner 200 within the wellbore 205 before expansion operations have begun. A temporary connection (not shown) between the liner 200 and the working string 225 is used to support the weight of liner 200 until the liner 200 is set within the wellbore 205. Once the liner 200 is hung from the upper casing string 210, the liner 200 is released from the working string 225. In one arrangement, the liner 200 is run into the wellbore 205 by use of a collet (not shown) at a lower end of the working string. However, other means for running the liner 200 into the wellbore 205 exist, such as the use of a set of dogs (not shown) which land into a radial profile (not shown) within a joint of liner.

The outer surface 265 of the liner 200 has a smaller outside diameter than the inner surface of the casing 210. In this way, the liner 200 can be run to total depth of the wellbore 205 through the upper string of casing 210. The liner 200 has an upper expandable section 235 proximate to the top 245 of the liner 200. The expandable region 235 may be made of a ductile material to facilitate expansion or, alternatively or in combination, its wall thickness may be altered.

In the arrangement of FIG. 2, the expandable section 235 includes an optional sealing member 260 disposed around the outer wall 265 of the liner 200. Preferably, the sealing member 260 is positioned at the uppermost section 245 of the liner 200. The sealing member 260 is used to provide a fluidly sealed engagement between the expandable section 235 of the liner 200, and the surrounding casing 210 when the liner 200 is expanded. In the preferred embodiment, the sealing member 260 is disposed circumferentially around the outer surface of the expandable region 235. In one aspect, a plurality of spaced apart seal rings (not shown) may be utilized.

The seal rings 260 are fabricated from a suitable material based upon the service environment that exists within wellbore 205. Factors to be considered when selecting a suitable sealing member 260 include the chemicals likely to contact the sealing member, the prolonged impact of hydrocarbon contact on the sealing member, the presence and concentration of erosive compounds such as hydrogen sulfide or chlorine and the pressure and temperature at which the sealing member must operate. In a preferred embodiment, the sealing member 260 is fabricated from an elastomeric material. However, non-elastomeric materials or polymers may be employed as well, so long as they substantially prevent production fluids from passing upwardly between the outer surface of the upper liner 245 and the inner surface of the casing 210 after the expandable section 235 of the liner 200 has been expanded.

In the arrangement of FIG. 2, the expandable section 235 also includes an optional slip member 270. The slip member 270 is used to provide an improved grip between the expandable section 235 and the casing 210 when the liner 200 is expanded. Preferably, the grip surface includes teeth (not shown) formed on a ring. However, the slip member 270 could be of any shape, and may have grip surfaces which include any number of geometric shapes, including button-like inserts (not shown) made of high carbon material. Preferably, a plurality of slip members 270 are utilized in a slip engagement section 250 of the liner 200. The size, shape and hardness of the slips 270 are selected depending upon factors well known in the art such as the hardness of the inner wall of casing 210, the weight of liner 200, and the arrangement of slips 270 used. When an expansion operation is conducted within the slip engagement section 250, each of the plurality of slips 270 is mechanically engaged into the inner wall of casing 210 thereby providing mechanical support for the liner 200.

It should again be noted that the employment of separate slip 270 and sealing 260 members are optional, though some mechanism of gripping is required. Further, other arrangements for slip and sealing members could be employed. For example, an elastomeric sealing material could be disposed in grooves within the outer surface of the upper portion 245 of the lower string of casing 200. Carbide buttons (not shown) or other gripping members could be placed between the grooves.

A lower portion 240 of the liner 200 is also visible in FIG. 2. The lower portion 240 includes a polished bore receptacle 25, or "PBR." For clarity, the PBR 25 is illustrated as a separate pipe component suitably joined to the lower section 240 of liner 200. It is to be appreciated, however, that the PBR 25 may be a separate tubular as illustrated, or may be an integral portion of the liner 200 whereby the upper expandable region 235 and lower portion 240 are formed from a single tubular. The PBR 25 is proximate to the top of the liner 200, but below the expandable section 235 of the liner 200.

Figure 3:
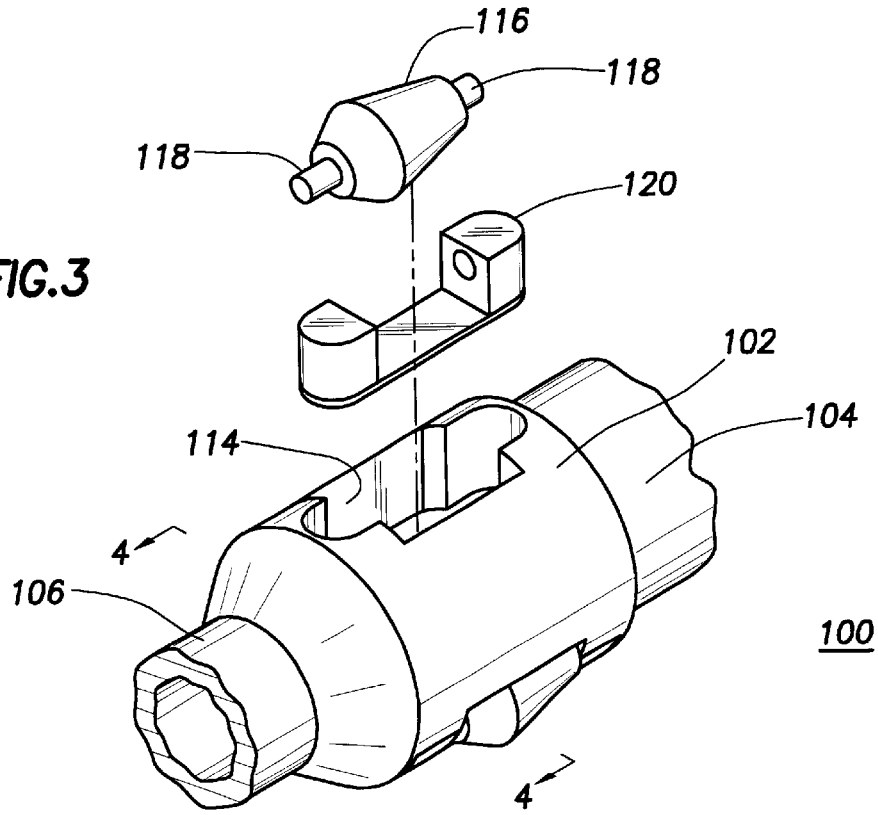
FIG. 3 is an exploded view of an expander tool as might be used in the methods of the present invention.
Figure 4:
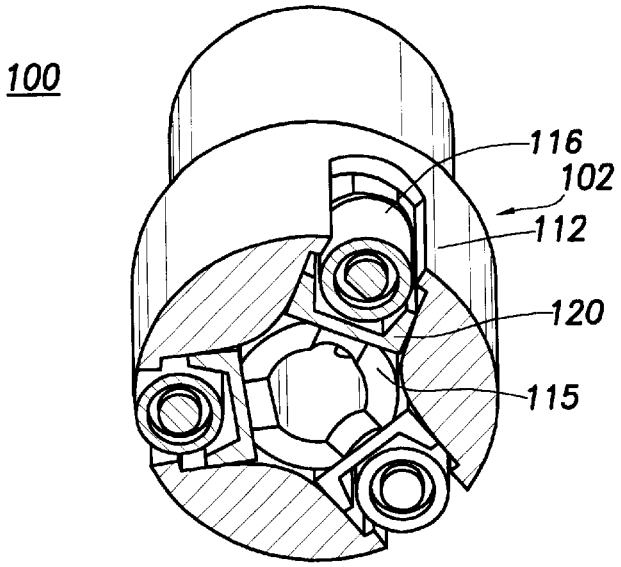
FIG. 4 is a cross-sectional view of the expander tool of FIG. 3, taken across line 4—4.

FIG. 2 also shows an exemplary expander tool 100 used to expand the liner 235 into the casing 210. A larger exploded view of the expander tool 100 is shown in FIG. 3. FIG. 4 presents the same expander tool 100 in cross-section, with the view taken across line 4—4 of FIG. 3.

The expander tool 100 has a body 102 which is hollow and generally tubular. Connectors 104 and 106 are provided at opposite ends of the body 102 for connection to other components (not shown) of a downhole assembly. The connectors 104 and 106 are of a reduced diameter (compared to the outside diameter of the body 102 of the tool 100). The hollow body 102 allows the passage of fluids through the interior of the expander tool 100 and through the connectors 104 and 106. The central body 102 has three recesses 114 to hold a respective roller 116. Each of the recesses 114 has parallel sides and holds a roller 116 capable of extending radially from the radially perforated tubular core 115 of the tool 100.

In one embodiment of the expander tool 100, rollers 116 are near-cylindrical and slightly barreled. Each of the rollers 116 is supported by a shaft 118 at each end of the respective roller 116 for rotation about a respective rotational axis. The rollers 116 are generally parallel to the longitudinal axis of the tool 100. The plurality of rollers 116 are radially offset at mutual 120-degree circumferential separations around the central body 102. In the arrangement shown in FIG. 3, only a single row of rollers 116 is employed. However, additional rows may be incorporated into the body 108.

While the rollers 116 illustrated in FIG. 3 have generally cylindrical or barrel-shaped cross sections, it is to be appreciated that other roller shapes are possible. For example, a roller 116 may have a cross sectional shape that is conical, truncated conical, semi-spherical, multifaceted, elliptical or any other cross sectional shape suited to the expansion operation to be conducted within the tubular 200.

Each shaft 118 is formed integral to its corresponding roller 116 and is capable of rotating within a corresponding piston 120. The pistons 120 are radially slidable, one piston 120 being slidably sealed within each radially extended recess 114. The back side of each piston 120 is exposed to the pressure of fluid within the hollow core 115 of the tool 100 by way of the tubular 225. In this manner, pressurized fluid provided from the surface of the well, via the tubular 225, can actuate the pistons 120 and cause them to extend outwardly whereby the rollers 116 contact the inner surface of the tubular 200 to be expanded.

The expander tool 100 is preferably designed for use at or near the end of a working string 150. In order to actuate the expander tool 100, fluid is injected into the working string 150. Fluid under pressure then travels downhole through the working string and into the perforated tubular core 115 of the tool 100. From there, fluid contacts the backs of the pistons 120. As hydraulic pressure is increased, fluid forces the pistons 120 from their respective recesses 114. This, in turn, causes the rollers 116 to make contact with the inner surface of the liner 200. Fluid finally exits the expander tool 100 through connector 106 at the base of the tool 100. The circulation of fluids to and within the expander tool 100 is regulated so that the contact between and the force applied to the inner wall of liner 200 is controlled. Control of the fluids provided to the pistons 120 ensures precise roller control capable of conducting the tubular expansion operations of the present invention that are described in greater detail below.

In the preferred method, the liner 200 and expander tool 100 are run into the wellbore 205 in one trip. The liner 200 is run into the wellbore 205 to a depth whereby the upper portion 245 of the liner 200 overlaps with the lower portion of the casing 210, as illustrated in FIG. 2. Expansion of the tubular 130 can then begin.

Figure 5:
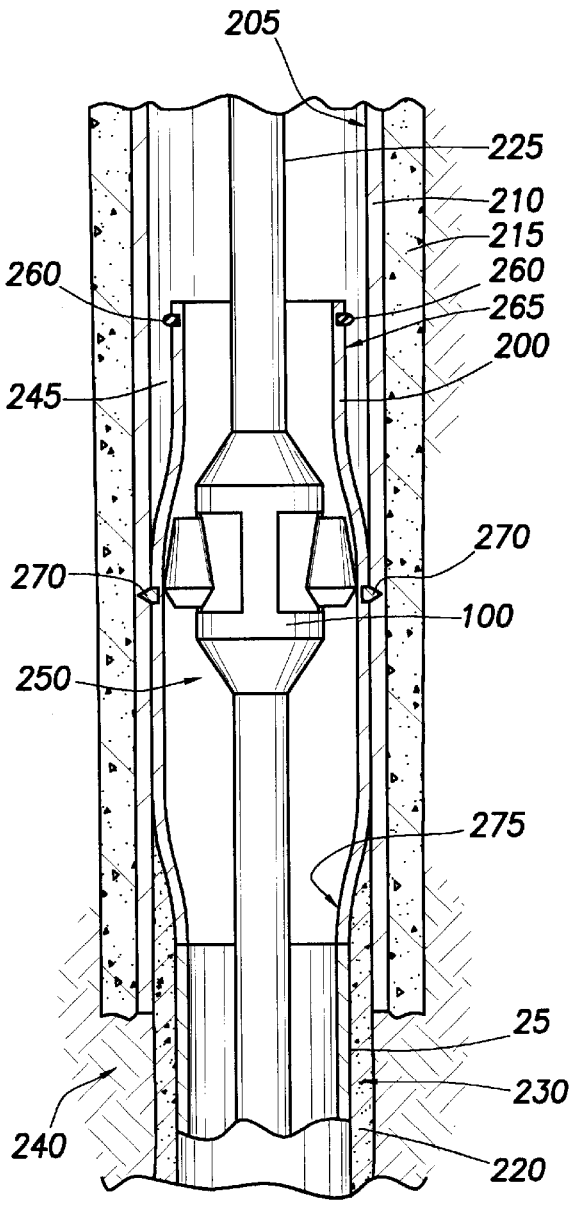
FIG. 5 is a sectional view of the wellbore of FIG. 2. In this view, the liner has been partially expanded into frictional engagement with the upper string of casing. Visible in this view is an inner diameter transition section formed between the expanded portion of the liner and a polished bore receptacle.

FIG. 5 is a sectional view of the wellbore of FIG. 2. In this view, the liner 200 has been partially expanded into frictional engagement with the upper string of casing 210. The expander tool 100 is actuated with fluid pressure delivered through the run-in string, thereby urging the rollers 116 radially outward. The liner wall 265 is expanded beyond the wall's elastic limit resulting in plastic deformation. The expander tool 100 is rotated in order to obtain a uniform radial expansion of the liner 200. Rotation of the expander tool 100 may be performed by rotating the run-in string or by applying hydraulic force such as, for example, by utilizing a mud motor (not shown) in the run-in string to transfer fluid power to rotational movement. The expander tool 100 is also raised within the wellbore 205 in order to expand the liner 200 along a desired length.

Figure 6:
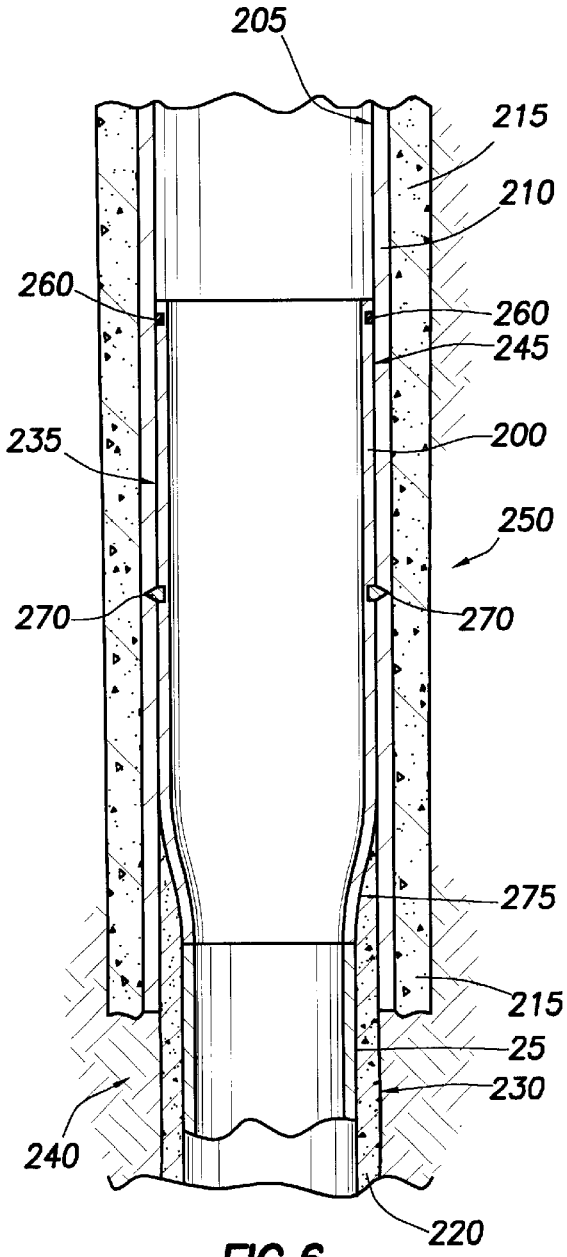
FIG. 6 is a sectional view of the wellbore of FIG. 5. In this view, the liner has been expanded into complete frictional engagement with the upper string of casing. The polished bore receptacle is disposed beneath the expanded portion, ready to receive a string of production tubing.

FIG. 6 depicts the wellbore 205 of FIG. 5, with the expanded liner portion 235 in complete frictional engagement with the casing 210. It can be seen that the slip member 270 has been expanded into the inner wall of the surrounding casing 210. As a result, the optional slip 270 is able to assist in the support the weight of liner 200. The liner 200 has also been expanded sufficiently to allow the sealing member 260 to contact with the inner wall of casing 210, thereby fluidly sealing the annulus between the outer wall of liner 200 and the inner wall of casing 210.

By utilizing the expander tool 100, the liner 200 is expanded into frictional engagement with the inner wall of the casing 210. Expansion operations typically increase liner wall inner diameters from about 10 percent to about 30 percent of original inner diameter value. The amount of deformation tolerated by the liner wall 265 depends on several factors, such as, for example, service environment, liner wall thickness, and liner metallurgy.

From the expansion shown in FIG. 6, it can be seen that the diameter of the expanded portion 235 of the liner 200 is greater than the diameter of the polished bore receptacle 25. It can also be seen that a transition section 275 has been created in the lower region 240 between the polished bore receptacle 25 and the expanded portion 235 of the liner 200. In this respect, the diameter of the transition section 275 gradually increases as the transition section 275 moves upward from the polished bore receptacle section 25.

Typically, the creation of the transition section 275 is a natural result of the expansion of the liner 200 above the PBR 25. However, when the working string is raised while the expander tool 100 is being pressured up, the length of the transition section 275 will be extended. A more gradual slope in the transition section 275 above the PBR 25 will result. The slope of the transition section 275 shown in FIG. 6 is essentially linear. However, as an alternative arrangement, the slope could be non-linear. In one embodiment of a liner 200 according to present invention, a portion of expandable liner 235 immediately above the PBR 25 is left unexpanded such that the initial slope is zero. It is understood, however, that the tensile and collapse strength of the expandable liner 235 will be greatest when the transition section is short.

Regardless of the configuration, the creation of a transition section 275 above the polished bore receptacle 25 serves a novel purpose in the protection of the PBR 25. In this respect, the transiting of tubulars and downhole tools through the PBR 25 carries the risk of harming the smoothed inner sealing surface of the inner diameter of the PBR 25. This, in turn, harms the seal sought to be obtained later with the bottom of the production tubing (not shown). The inner diameter of the transition section 275 is configured to absorb the impact of tools and tubulars transiting downhole. In addition, the creation of a transition region 275 reduces the likelihood of damage resulting from misaligned tools and tubulars. By adjusting the first and second rates of inner diameter change in the transition section 275, the inner diameter of the upper expandable region 235 is advantageously utilized to protect the inner sealing surface of the polished bore receptacle 25 from the tools employed to perform drilling and other downhole operations. Tubulars and other tools transiting through the upper expandable region 235 will likely contact the inner wall of the expandable section 235 and be guided towards the center of the liner 200.

It is to be appreciated that the relative sizes and positions of upper expandable region 235 and lower region 240 are for purposes of illustration and clarity in discussion. Additionally, FIGS. 2, 6 and 7 are not to scale. For example, PBR 25 may be from about directly beneath the transition section 275 to more than 30 feet. Similarly, sealing member 260 and slip member 270 may also be separated by several feet, or they may be integral to each other. While the transition section 275 is illustrated and described as directly joining to PBR 25, it is to be appreciated that in other embodiments of the present invention, the PBR 25 may be several feet below the transition section 275.

After expansion operations within the liner 200 are completed, rollers 116 are retracted and the expander tool 100 is withdrawn from the wellbore 205. In FIG. 6, the expander tool 100 has been removed.

Embodiments of the present invention solve the problem of maintaining an effective polished bore receptacle within an expanded liner. The expanded portions of the tubular member provide an effective seal and anchor within the liner. Additionally, the tubular member, once expanded, reinforces the liner hanger section therearound to prevent collapse. Additionally, the expanded sections of the inventive liner may be used to prevent impact of tools and piping onto tubular sealing surfaces, such as the sealing surfaces of a polished bore receptacle. While a tubular member of the invention has been described in relation to an expandable liner top, the tubular could be used in any instance wherein a polished bore receptacle is needed in an expandable tubular, and the invention is not limited to a particular use.

While the foregoing is directed to embodiments of the present invention, other and further embodiments of the invention may be devised without departing from the basic scope thereof, and the scope thereof is determined by the claims that follow.

We claim:

1. A method for positioning a polished bore receptacle within a wellbore, the wellbore having a first string of casing therein, comprising the steps of:

running a tubular into the wellbore, said tubular having a polished bore receptacle proximate to a top portion of the tubular, and an expandable section above the polished bore receptacle;

positioning the tubular in the wellbore such that at least said expandable section of said tubular overlaps with a bottom portion of the first string of casing; and expanding said expandable section of said tubular such that an outer surface of said tubular is in frictional engagement with an inner surface of the first string of casing.

2. The method for positioning a polished bore receptacle within a wellbore of claim 1, wherein a transition section is defined between said expandable section of said tubular and the polished bore receptacle after said step of expanding said expandable section, said transition section having an inner surface and an outer surface, said inner surface having:

a first inner diameter proximate to said expandable section; and a second inner diameter proximate to said polished bore receptacle, said first inner diameter being greater than said second inner diameter.

3. The method for positioning a polished bore receptacle within a wellbore of claim 2, wherein said tubular is a second string of casing.

4. The method for positioning a polished bore receptacle within a wellbore of claim 2, wherein the slope of the inner diameter of the transition section increases linearly as the transition section moves from the polished bore receptacle upward to the expandable section.

5. The method for positioning a polished bore receptacle within a wellbore of claim 2, wherein the slope of the inner diameter of the transition section increases non-linearly as the transition section moves from the polished bore receptacle upward to the expandable section.

6. The method for positioning a polished bore receptacle within a wellbore of claim 2, wherein said inner surface of said transition section is formed such that subsequent to the expansion operation, tools transiting through said tubular will likely contact said inner surface before being positioned adjacent the polish bore receptacle, and be directed towards the center of said tubular.

7. The method for positioning a polished bore receptacle within a wellbore according to claim 2, wherein said outer surface of said expandable section of said tubular has at least one seal member for providing a seal between said outer surface of said tubular and the first string of casing when said tubular is expanded into frictional engagement with the first string of casing.

8. The method for positioning a polished bore receptacle within a wellbore of claim 2, wherein said outer surface of said expandable section of said tubular also has at least one gripping member for assisting in said engagement between said tubular and the first string of casing when said tubular is expanded into engagement with the first string of casing.

9. A method of completing a wellbore, the wellbore having a first string of casing therein, comprising the steps of:

running a second string of casing into the wellbore, said second string of casing having a polished bore receptacle proximate to a top portion of the second string of casing, and an expandable section above the polished bore receptacle;

positioning the second string of casing in the wellbore such that at least said expandable section of said second string of casing overlaps with a bottom portion of the first string of casing;

expanding said expandable section of said second string of casing such that an outer surface of said second string of casing is in frictional engagement with an inner surface of the first string of casing; and partially expanding a transition section between the polished bore receptacle and the expandable section, the transition section having an inner surface and an outer surface, said inner surface having:

a first inner diameter proximate to said expandable section; and a second inner diameter proximate to said polished bore receptacle, said first inner diameter being greater than said second inner diameter.

10. The method of completing a wellbore of claim 9, wherein said outer surface of said expandable section of said second string of casing has:

at least one seal member for providing a seal between said outer surface of said second string of casing and the first string of casing when said second string of casing is expanded into frictional engagement with the first string of casing; and at least one gripping member for assisting in the engagement between said second string of casing and the first string of casing.

11. A liner for use in a wellbore, the liner having a top portion and a bottom portion, comprising:

an expandable section proximate to the top portion of the liner, said expandable section having an inner surface and an outer surface, and said expandable section being expandable by a radial outward force applied against said inner surface; and a lower portion below the expandable section, said lower portion also having an inner surface and an outer surface, and said lower portion having a polished bore receptacle formed therein.

12. The liner of claim 11, further comprising:

at least one seal member disposed circumferentially around said outer surface of said expandable section; and at least one slip member disposed on said outer surface of said expandable section.

13. The liner of claim 12, wherein said polished bore receptacle is an integral portion of the liner.

14. The liner of claim 12, wherein said liner is formed by joining together an expandable pipe and a pipe comprising a polish bore receptacle.

15. A method for positioning a polished bore receptacle within a wellbore, the wellbore having a first string of casing therein, the method comprising:

running a tubular into the wellbore, the tubular having a polished bore receptacle proximate to an upper portion of the tubular, and an expandable section above the polished bore receptacle;

positioning the tubular in the wellbore such that at least the expandable section of the tubular overlaps with a lower portion of the first string of casing; and expanding the expandable section of the tubular such that an outer surface of the tubular is in engagement with an inner surface of the first string of casing, wherein the outer surface of the expandable section of the tubular also has at least one gripping member for assisting in the engagement between the tubular and the first string of casing when the tubular is expanded into engagement with the first string of casing.

16. The method for positioning a polished bore receptacle within a wellbore of claim 15, wherein a transition section is defined between the expandable section of the tubular and the polished bore receptacle after the step of expanding the expandable section, the transition section having an inner surface and an outer surface, the inner surface having:

a first inner diameter proximate to the expandable section; and a second inner diameter proximate to the polished bore receptacle, the first inner diameter being greater than the second inner diameter.

17. The method for positioning a polished bore receptacle within a wellbore of claim 16, wherein the inner surface of the transition section is formed such that subsequent to the expansion of the expandable section, tools transiting through the tubular will likely contact the inner surface of the transition section before being positioned adjacent the polish bore receptacle, and be directed towards the center of the tubular.

18. The method for positioning a polished bore receptacle within a wellbore according to claim 17, wherein the outer surface of the expandable section of the tubular has at least one seal member for providing a seal between the outer surface of the tubular and the first string of casing when the tubular is expanded into engagement with the first string of casing.

* * * * *